United States Patent [19]

Fisher et al.

[11] 4,008,762

[45] Feb. 22, 1977

[54] EXTRACTION OF HYDROCARBONS IN SITU FROM UNDERGROUND HYDROCARBON DEPOSITS

[76] Inventors: Sidney T. Fisher, 53 Morrison Ave.; Charles B. Fisher, 2850 Hill Park Road, both of Montreal, Quebec, Canada

[22] Filed: Feb. 26, 1976

[21] Appl. No.: 661,770

[52] U.S. Cl. ..... 166/248; 166/256; 166/272; 219/10.79

[51] Int. Cl.[2] ..... E21B 43/24

[58] Field of Search ..... 166/248, 302, 256, 303, 166/268, 272, 60; 219/10.79, 10.75, 10.57, 277, 278

[56] References Cited

UNITED STATES PATENTS

| | | | |
|---|---|---|---|
| 2,472,445 | 6/1949 | Sprong | 166/60 |
| 2,801,090 | 7/1957 | Hoyer et al. | 166/60 X |
| 2,856,296 | 10/1958 | Mann et al. | 219/10.79 |
| 2,859,952 | 11/1958 | LaTour et al. | 219/10.57 |
| 2,889,882 | 6/1959 | Schleicher | 166/248 |
| 3,294,167 | 12/1966 | Vogel | 166/272 |
| 3,440,384 | 4/1969 | Schroeder | 219/10.79 X |
| 3,548,938 | 12/1970 | Parker | 166/256 |
| 3,864,208 | 2/1975 | Huisen | 166/303 X |

*Primary Examiner*—Stephen J. Novosad
*Attorney, Agent, or Firm*—Barrigar & Oyen

[57] ABSTRACT

A method of extracting hydrocarbons in situ from an underground hydrocarbon deposit such as oil shale. A selected part of the deposit is heated by one or more electrical induction coils arranged in a quasi-toroidal configuration to temperatures high enough to drive off hydrocarbon fractions as gases or vapors, which are then collected and utilized in surface operations or recovered for transportation or temporary storage. The deposit may optionally be heated through a coking and cracking stage. Any remaining hydrocarbons may be burned in situ and the combustion gases utilized for energy. Steam may be obtained by injecting water into the heated shale after extraction of the hydrocarbons.

11 Claims, 8 Drawing Figures

EXTRACTION OF HYDROCARBONS IN SITU FROM UNDERGROUND HYDROCARBON DEPOSITS

FIELD TO WHICH THE INVENTION RELATES

The present invention relates to a method of extracting hydrocarbons from an underground deposit of naturally occurring hydrocarbons, such as kerogen entrapped within a deposit of shale or the like.

BACKGROUND OF THE INVENTION

In Colorado and other areas of the United States are located what are popularly known as "oil shales" occasionally exposed at the surface of the ground but generally overlaid by overburden to varying depths. Oil in the form of kerogen is entrapped within the shale deposits. For many years efforts have been made to recover the oil, and several processes have been proposed for the purpose. Many proposals have involved first the mining of the shale and then the surface extraction of the oil from the mined shale. The mining techniques and associated extraction techniques have generally involved intolerably high capital investments, energy expenditures, ecological damage, and extraction and refining costs.

SUMMARY OF THE INVENTION

The invention is a method of extraction and processing in situ of underground hydrocarbons located in an underground hydrocarbon or hydrocarbon-bearing deposit such as oil shale which comprises the heating by electrical induction of a selected portion of the deposit to a temperature sufficient to vaporize or gasify at least some of the hydrocarbons located in the selected portion and then collecting the vaporized or gasified hydrocarbons. By "hydrocarbon" is meant one or more of the constituents of naturally-occurring deposits of petroleum, kerogen, lignite, etc. composed of the elements hydrogen and carbon, sometimes with the addition of other elements.

The heating is effected by a quasi-toroidal configuration of conductor turns, preferably interrupted turns of rectangular shape and connected in parallel, and located underground so as substantially to encompass the selected portion of the hydrocarbon deposit. The electrical induction heating is continued for a period of time sufficient to raise the temperature of the contents of the deposit to a level sufficient to enable at least some of the contents to vaporize and to permit the hydrocarbon vapors of any liquids released by the process to be collected from one or more suitable wells.

In some cases, the heavier fractions of the hydrocarbon deposit may tend not to vaporize but may remain in situ in the form of coke, which is formed at sufficiently elevated temperatures. The coke, however, may upon further heating be found to "crack" sufficiently to enable some of the constituent hydrocarbons to be driven off as gaseous or vaporized fractions. (A catalyst may be desirable or necessary to facilitate cracking, and for that purpose may be introduced into the deposit via suitable injection wells.) Thus the light fractions which are vaporized or gasified at a temperature lower than the coking temperature can first be collected from conventional gas or distillate extraction wells, the deposit can then be raised to coking temperature and still further to cracking temperature, and then the additional gaseous or vaporized hydrocarbon fractions can be collected from the same extraction wells. It is also conceivable that some of the hydrocarbons may be collectable as liquids released by the process.

As mentioned above, the induction heating coil configuration utilized in accordance with the present invention is quasi-toroidal. The following discussion is intended to facilitate a comprehension of the meaning of the term "quasi-toroidal."

A surface of revolution is a surface generated by revolving a plane curve about a fixed line in its plane. The line is called the axis of the surface of revolution.

A conventional torus is a surface of revolution generated by a circle offset from the axis, which circle, when it moves about the axis through 360°, defines the torodial surface. The section of the torus is the circle which generated it. The inner radius of the torus is the distance between the axis and the nearest point of the circle to the axis, and the outer radius of the torus is the distance between the axis and that point on the circle most remote from the central axis. When a coil of wire is formed having the overall shape of a torus, the coil is said to form a "toroidal conductive envelope," since it envelopes a generally toroidal space.

Toroidal inductor coils are well known in electrical engineering. Conventionally, a continuous coil of wire is formed into a torus thereby forming a toroidal envelope having a circular section. Since the coil is a continuous conductor, it follows that the turns of which the toroidal coil is formed are series connected. Such a toroidal coil has the desirable property that its electromagnetic field is substantially confined to the interior of the torus.

The present invention is concerned not with true toroidal envelopes but rather with quasi-toroidal envelopes formed by a plurality of discrete interrupted turns lying at different angles so as to approximately surround the volume lying within the envelope. By "interrupted turn" is meant a turn having a discrete discontinuity small with respect to the length of the turn.

A first distinction between a quasi-toroidal envelope and a toroidal envelope is that the turns of the quasi-toroidal envelope do not necessarily form a complete closed curve as is the case (except for the terminals) in a toroidal envelope, but instead each takes the form of an interrupted turn — i.e. a curve which includes a discontinuity (there must necessarily be an electrical discontinuity in order that an electric current may be passed through the quasi-toroidal envelope from one side of the discontinuity to the other).

A further point of distinction is that a quasi-toroidal envelope need not be a surface of revolution, nor does its section have to approximate a circle. A quasi-toroidal surface includes not only surfaces of revolution formed or approximately by rotation of an interrupted circle about an axis but also any practicable topological equivalent thereof, such as a surface of revolution generated by an interrupted rectangle, or such surface "stretched" generally perpendicular to the axis so that an oblong or slab-shaped surface results. Because of the difficulty of drilling curved tunnels underground, a rectangular turn configuration is preferred, comprising only substantially horizontal and vertical conductive elements. (The "horizontal" conductors may depart from the horizontal to follow the upper and lower boundaries respectively of an oil shale deposit.)

A characteristic of a quasi-toroidal conductor configuration (and indeed also of a toroidal inductor) is that the electromagnetic field strength is highest near the inner radius of the quasi-torus and therefore the hydrocarbons may be expected to liquefy or vaporize, as the case may be, more quickly at the inner radius than at the outer radius. This means that extraction of the liquid or vapor fractions of the hydrocarbon deposit can conveniently be made from a location at or within the inner radius of the quasi-toroidal configuration, but it also implies that as the hydrocarbons are extracted, an increasing current will be required in the quasi-toroidal turns to maintain the field strength sufficient to liquefy or vaporize the hydrocarbons lying towards the outer radius of the quasi-torus. Eventually the required current may become intolerable, and in the absence of corrective measures, the operation would have to come to a halt.

It is accordingly further proposed according to the invention that progressive extension of the quasi-toroidal conductor configuration to quasi-toroidal structures of increasing radius be utilized as hydrocarbons become exhausted from the underground regions near the inner radius of the quasi-torus. If the conductors are arranged initially in a hexagonal array, the hexagonal array can continue to be maintained as the quasi-toroidal radius is increased up to some convenient maximum radius. Use of the hexagonal configuration, moreover, implies that any area of land canconveniently can conveniently sub-divided into a hexagonal gridwork, which would permit convenient extraction of as much of the hydrocarbon as economically possible from the hydrocarbon formations underlying the surface hexagonal grid.

In a preferred embodiment of the invention, a central vertical shaft is excavated from the surface to the bottom of an underground hydrocarbon deposit or some other convenient point within the underground hydrocarbon deposit. Vertical shafts or drill holes are also sunk at locations corresponding generally to the apexes of a hexagon whose centre is located generally at the centre of the central vertical shaft. From a point within the central shaft located at or near the top of the underground hydrocarbon layer, horizontal tunnels are excavated radially outwardly towards each of the hexagonally located vertical shafts. These horizontal tunnels can be continued to a radius considered to be a suitable maximum for a given grid element.

If a six turn configuration is to be used, the angle between adjacent tunnels will be 60%. Six vertical shafts or drill holes are arranged to intersect the horizontal tunnels at equal distances from the central shaft. If the diameter of the central shaft is, say, 2 metres, the first set of vertical shafts spaced outwardly from the tunnel might be arranged at about 7 metres from the central vertical shaft. This would enable the vertical and horizontal conductive elements placed in the central shaft, in the vertical drill holes and in the horizontal tunnels, to encompass an annular quasi-toroidal portion of the deposit lying between the central shaft and the spaced drill holes, and lying between the upper and lower tunnels, which latter as indicated previously are suitably placed respectively at the upper and lower extremities of the hydrocarbon deposit.

Assuming then that the innermost quasi-torus is defined by the 2 metre central shaft and a hexagonal array of vertical drill holes at about 7 metres from the central shaft, the next step is to arrange a further pattern of drill holes to intersect the continuation of the horizontal tunnels at a further distance from the central shaft. This next set of vertical drill holes can be arranged to be at a relatively greater distance from the central shaft than were the first set of drill holes. The next set of vertical drill holes, for example, might be located at a distance of say 40 metres from the central shaft. If a further set of turns beyond the 40 metre distance is to be provided, the next succeeding set of drill holes might be located at, for example, 200 metres from the central shaft. At that distance from the central shaft, the working of the underground deposit would be expected to take several years.

The reason for the foregoing spacing of vertical drill holes is this. In a toroidal or quasi-toroidal conductor configuration, the electromagnetic field strength is highest near the inner turn extremities and lowest near the outer coil extremities. As a consequence, the hydrocarbons near the inner turn extremities will be liquefied or vaporized first, and liquefaction or vaporization will occur progressively outwardly from the innermost turns to a point at which the further economic recovery of material from the deposit becomes impracticable. As hydrocarbons are extracted from, say, the inner quasi-toroidal envelope region, the current required to maintain the hydrocarbons in a state of liquefaction or a state of vaporization, as the case may be, become increasingly high, since the amount of conductive material lying within the electromagnetic field generated by the conductive turns becomes increasingly small. Eventually a point is reached at which the turns become too hot or the current becomes too high to permit any further extraction of hydrocarbon. This point is determined in part by the ratio of the diameter of the inner set of conductor turn segments to the diameter of the outer conductive turn elements. Studies performed on mathematical models indicated that at least for some significant underground hydrocarbon deposits, such as the bituminous sands of Alberta, the ratio of outer envelope radius to inner envelope radius for the quasi-toroidal envelope should never exceed about 10, with a ratio nearer 5 to 1 being preferred. This means that if the radius of the central shaft is substantially the inner radius of the innermost quasi-toroidal envelope, then the innermost quasi-toroidal envelope should have an outer radius of the order of 5 times that of the central shaft. The next adjacent quasi-toroidal envelope may have an inner radius of 5 times the central shaft radius and an outer radius 25 times the central shaft radius, and so on progressively outwards until some maximum radius is reached representing the economical upper limit for the working of the particular deposit in question.

It will be seen from the foregoing that if as few as six sets of turns are used, the effective electromagnetic field produced by the turns necessarily deviates from the field that would be produced if a much larger number of turns were used to define the invelope. The term "quasi-toroidal" used in the specification is intended to embrace the approximation of a true annular volume or envelope within which the electromagnetic field generated by a relatively small number of conductive turns, usually fewer than twenty and, in many of the examples to be considered, six, permeates.

The progressive heating proposal according to the invention, i.e. the progressive utilization of quasi-toroidal envelopes of increasingly large radii, results in a saving in drilling and in conductor utilization, since at least some of the innermost vertical conductor elements of an outer quasi-toroidal envelope can conveniently be the outermost vertical conductive elements of the next adjacent inner quasi-toroidal envelope. Furthermore, the horizontal tunnelling can be relatively easily accomplished at the outset for the entire set of horizontal tunnels, because the horizontal conductive elements of the outer quasi-toroidal envelope, or at least some of them, are conveniently formed in alignment with the horizontal conductive elements of the inner quasi-toroidal envelope, thus enabling the same horizontal tunnelling to be used to place the conductors. (In some circumstances, it may be desirable to increase the number of turns as the outer radius of the quasi-torus increases.)

The extraction technique according to the invention affords to potential advantage that not only extraction per se but also at least some of the refining process can be effected underground, thus tending to make efficient use of the underground heat input. Furthermore, once all fractions are collected that can be driven off by vaporization or following the cracking of any residual coke, the possibility exists of injecting air into the underground deposit, which will enable the unextractable hydrocarbon residues to be burned, thereby to generate heat. The heat can be recovered for example by heat exchange from the exhaust gases and by injecting water into the hot underground mass and recovering the water in the form of steam, which can then be used to drive turbines for use in the generation of electricity, or used as process steam in subsequent refining stages.

Judicious use of energy and materials extracted from the underground deposit should result in the extraction to the surface of a maximum percentage of the available energy in the deposit, and may provide all or part of the energy expended in the extraction process. This extracted energy thus may be expected to reach the surface in several different forms: hydrocarbon fractions that are gaseous at normal temperature and pressure, hydrocarbon fractions that are liquid at normal temperature and pressure, hot carbon dioxide and nitrogen, and steam, are the principal forms. Sulfur may also appear, and by careful management it will occur mostly as a vapor, which can be condensed and so reduced to elemental sulfur in solid form at the surface, whereby the difficult problem of sulfur pollution of the environment in the utilization of such deposits may be satisfactorily solved.

It is accordingly preferred in accordance with the invention that when all the available hydrocarbon fractions have been extracted by the electrical induction heating of the underground deposit, air (or oxygen) is then admitted, and the remaining carbon is burned. By admitting water, the heat of combustion, and part of the heat stored in the shale which was derived from the electrical induction heating of the deposit, are utilized in converting the water to steam, which is led to the surface. This process continues until all the carbon is consumed, and the underground deposit has been reduced by the injection of water to the lowest temperature at which the resultant steam is utilizable.

The foregoing processes can be utilized for a number of desirable purposes, including not only the production of hydrocarbon fractions for storage or direct sale or use, but also for production of mechanical or electrical energy or for various petrochemical processes. Judicious combinations of processes can be expected to result in improved efficiency of utilization of the energy content of the deposits, in lower costs for the end products, in the reduction of atmospheric pollution, in the reduction of thermal pollution, in the reduction of environmental damage by spoil piles, tailings ponds and the like, and in the reduction of transportation costs, since final products rather than semi-processed (and therefore heavier and bulkier) materials, may be transported from the energy site to the point of use (which may be, and generally is, a considerable distance away).

One combined process which has a number of advantages is the generation of electricity at the energy site by power gas, using it in combined-cycle gas and steam turbines driving electric generators. This is a cheap way to produce electricity, and the technology is immediately available. A clear distinction must be made between power gas, which has a heating value of 150 Btu or less per standard cubic foot (SCF), and synthetic natural gas, which has a heating value of about 1000 Btu per SCf. Power gas cannot be economically transported very far; it must be used near the site of production. Whereas the production of synthetic natural gas is one of the more difficult problems known in chemical engineering, the production of power gas is extremely simple, and can be carried out in underground hydrocarbon deposits heated by electrical induction. A high percentage of the energy content of the deposits should be thus extractable. The power gas can be burned underground by the injection of air, and the resultant exhaust gases, at a temperature of say 1000°to C, used to drive a gas turbine at the surface. Typically the outlet temperature for such a turbine is 445° C, and this exhaust gas may be delivered to a steam boiler, the steam from which may drive a steam turbine. Both the gas and steam turbines may be coupled to generators, with an expected combined efficiency of about 40%, the efficiency of the gas turbine alone being only about 25%. In addition, the quenching of the burned deposit with water should produce a large volume of steam which may also be utilized in the steam turbine, so that substantially all of the available energy in the deposit may be utilized by the combined cycle.

The discussion above covers the production of power gas in the underground deposit. However, all other gases or vapors derived from the electrical induction heating of the underground deposit may also optionally be burned, underground or on the surface, to provide driving power for the gas turbine. The carbon dioxide resulting from the burning underground of the residual carbon may also be utilized in gas turbine after all hydrocarbons have been extracted. This is an efficient method of generating electricity from in situ heating of underground hydrocarbon deposits: almost complete extraction of the available energy in the deposit, consisting of hot gases and steam, fed to combined-cycle gas and steam turbines with the required capacities to utilize the two sources of energy with maximum possible efficiency, is to be expected. The foregoing discussion envisages the generation of electricity as the end product, since this is a conventional way in which large amounts of mechanical energy are utilized. It is not the only way, however, and the following are other examples of processes which require large amounts of mechanical energy which could be obtained directly from the turbines: water pumping, oil pumping; rock crushing; cement making, pulverization, grinding, or ore crushing.

Alternatively, the underground hydrocarbon deposit, which may be e.g. oil shale, when heated and catalytically cracked, should produce by distillation a series of fractions which when conducted to the surface may optionally be up-graded by hydrogenation or combined to form crude petroleum, or both. Fractions which are gaseous at normal temperature and pressure may be transported to users if of sufficiently high heat value, or burned at the energy site to provide process heat or to drive gas turbines and generate electricity, pump water, and so forth. Some of the liquid fractions may be utilizable directly, and if so can be transported to users. The remaining fraction then may be combined, up-graded, and refined to produce petroleum products, such as gasoline, kerosine, fuel and Diesel oils, lubricating oils, and so on. Distillation separates the crude oil into fractions. Thermal or catalytic cracking may be used to convert some of the heavier fractions to lighter fractions. Catalytic reforming, isomerization, alkylation, polymerization, hydrogenation, and combinations of these catalytic processes may be used to upgrade the various refinery intermediates into improved gasoline stocks or distillates. These processes require as feedstock the hydrocarbon fractions obtained by electrical induction heating of the underground deposits. They also require large amounts of low and high-temperature heat, mechanical energy for pumping etc., and electricity for lighting and other operations. All of these can be provided at the energy site, by the induction heating process.

Since it is not possible to transmit economically hot gases, steam, and low heat-value gas to a point remote from the energy site, an efficient utilization of the energy in the deposit is achieved by locating the refinery at the energy site, and utilizing directly in the surface operations the combined energy in various forms derived from the deposit.

Another manufacturing process which when combined with extraction of energy from a hydrocarbon deposit by electrical induction heating results in a relatively high overall efficiency and low cost, is the manufacture of Portland cement, in cases where the raw materials are located proximate to the source of energy. Portland cement is made from a mixture of about 80% carbonate of lime (limestone, chalk, or marl) and about 20% clay, shale, or slag. The materials are pulverized and mixed, finely ground, and then calcined in kilns to a clinker. The clinker is cooled, and ground to a fine powder. The calcining takes place at a high temperature, above 1500° C, and a large amount of heat is required. The large input of heat and mechanical power required can be obtained directly from electrical induction heating of the hydrocarbon deposit, in the required proportions, leaving only the final product, cement, to be transpoted to the user, and saving the interfaces and consequent inefficiency required by long-distance transmission of energy.

Another process which utilizes both the hydrocarbon fractions obtained by the electrical induction heating of an underground deposit, and the additional energy available as heat, in an integrated installation which permits large economies of equipment and energy, is the manufacture of synthetic natural gas, or of other gases of sufficient heat value to permit economical transportation long distances by pipeline. There are a number of processes for the production, but the basic chemistry in all of them is that carbon from naphtha, the hydrocarbon fraction with a boiling point between 125° C and 240° C, is combined with water at high temperature to form methane, the principal constituent of natural gas. The overall reaction requires several steps, and typically is carried out as follows:

Vaporized naphtha, such as is obtained in the electrical induction heating of an underground hydrocarbon deposit, is superheated under pressure and catalytically desulfurized. The sulfur-free vapor is then reacted with steam at a temperature of 500° C to 540° C and a pressure of 34 atmospheres to form synthesis gas and carbon dioxide. Synthesis gas is a mixture of methane, hydrogen, and carbon monoxide. This gas is then subjected to a catalytic methanation at high temperature and pressure in which three molecules of hydrogen are combined with one of carbon monoxide to form more methane. The water and carbon monoxide are removed, leaving a gas 95% to 98% methane with an energy content of about 1000 Btu per standard cubic foot, the same value as natural gas.

When a synthetic natural gas plant is integrated with an energy site in which the underground hydrocarbon deposit is heated by electrical induction, both the feedstock, vaporized naphtha, and the large amounts of high-temperature heat and mechanical energy are directly available in the proportions required. The result is that the underground deposit is converted with high efficiency in a single sequence of operations at a single site to synthetic natural gas, the most versatile and least polluting fuel available, which can be transported economically to great distances by pipeline.

A number of examples have been discussed above, of the integration of a surface manufacturing operation integrated with the heating by electrical induction of an underground hydrocarbon deposit, in which a uniquely favourable result is obtained, in terms of energy utilization, atmospheric and water pollution, efficiency of production, cost, and plant required. Other instances, which need not be discussed but will only be mentioned, where both the feed-stock and the energy requirements are provided by the deposit, include the manufacture of the following chemicals:

| | |
|---|---|
| Ammonia | The Xylenes |
| Methanol | Naphthalene & higher aromatics |
| Oxo alcohols | Acetylene |
| Aromatics | Ethylene |
| Olefins | Propylene |
| Toluene & benzene | |

In addition all the derivatives of these chemicals can be listed, derivatives which with few exceptions are advantageously produced in an integrated operation, since they in turn depend largely on the availability of a large energy source.

DETAILED DESCRIPTION WITH REFERENCE TO THE DRAWINGS

Figure 1:
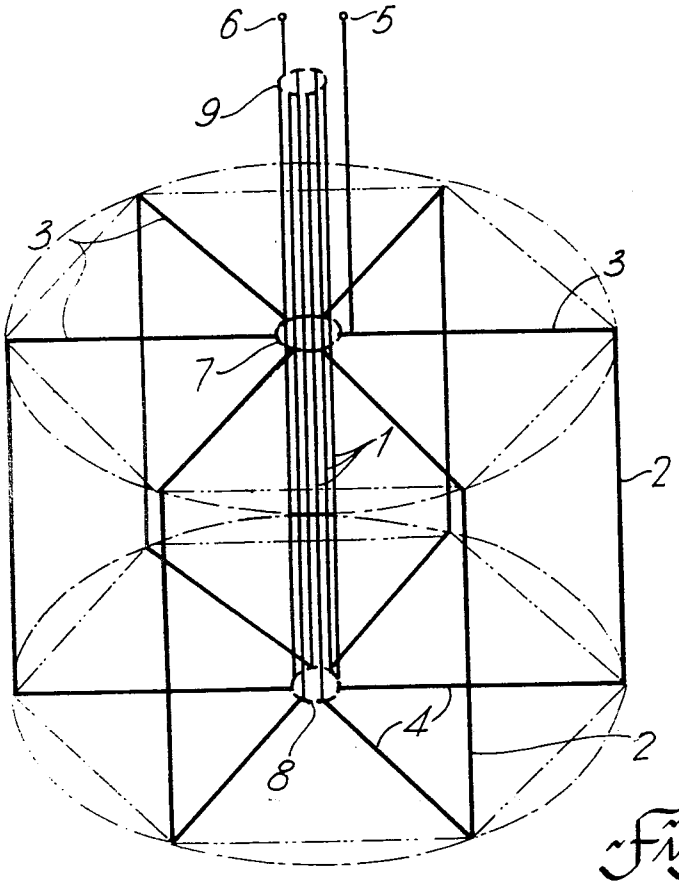
FIG. 1 is a schematic diagram showing the coil structure for a quasi-toroidal envelope for use in accordance with the invention.

FIG. 1 illustrates schematically an embodiment of an inner quasi-toroidal envelope constructed in accordance with the present invention. Within a hydrocarbon deposit, inner vertical conductor segments 1 are connected by upper horizontal conductor segments 3 and lower horizontal conductor segments 4 to outer vertical conductor elements 2. In FIG. 1, by way of example, six turns are illustrated, each turn being composed of two vertical conductor elements 1 and 2 and two horizontal conductor elements 3 and 4 so as to form a substantially rectangular turn. The turns are arranged at angles of 60° to one another to define a generally hexagonal configuration, with the outer vertical conductor elements 2 lying at the apices of a notional regular hexagon. The inner conductors 1 also lie on the apices of an inner notional hexagon. By "notional hexagon" is meant that there is no actual structure defining the entire perimeter of the hexagon; only the apices of the respective hexagons are defined by physical structure.

The upper horizontal conductive elements 3 are shown interconnected by a conductive annular ring 7 to a terminal 5 for connection to one terminal of a source of alternating current (not shown). The inner vertical conductors 1 extend vertically upwards, from their respective points of connection to lower horizontal connectors 4, to an annular connecting conductor 9 which is connected to a terminal 6 for connection to the other terminal of the source of alternating current (not shown). The conductors 1 are insulated from the annular ring 7 and from the upper horizontal conductor elements 3 so that at the inner upper corner of each rectangular turn there is a discontinuity. This of course is essential in order that current flow around the parallel-connected rectangular turns. The term "interrupted turn" is sometimes used herein to indicate that such a discontinuity is present.

When alternating current is applied to terminals 5 and 6, an electromagnetic field is generated by the rectangular coils. The electromagnetic field tends to permeate a quasi-toroidal space which differs from a true toroidal space not only because of the drop-off in field between conductive turns (especially at their outer extremities) but also because of the interrupted rectangular turn configuration in distinction from the usual circular turn configuration which would appear in conventional small-scale toroidal inductors. The quasi-toroidal space has an inner annular radius defined by the radius of the conductive connecting ring 7 (or by the radius of the notional circle on which the junction points of conductors 1 with conductors 4 lie). The outer radius of the quasi-toroidal space is defined by the outer vertical conductor elements 2. The upper limit of the quasi-toroidal space is defined by a notional horizontal annular surface in which the upper conductor elements 3 lie. A similar notional annular surface in which the lower elements 4 lie defines the lower boundary of the quasi-toroidal space. Thus the turns formed by the inner and outer vertical conductor elements 1 and 2 and the upper and lower horizontal conductor elements 3 and 4 together form a quasi-toroidal envelope which substantially surrounds the quasi-toroidal space defined above. Obviously the more turns that are used in the envelope, the more closely the actual electromagnetic field will extend throughout the entire quasi-toroidal space surrounded by the envelope. However, bearing in mind that tunnelling or drilling is required for the introduction of each of the conductor elements into an underground hydrocarbon deposit, a trade-off must be made between the efficiency of generation of the electromagnetic field within the quasi-toroidal space and the economies obtained by minimizing the number of holes or tunnels drilled or excavated. In the discussion which follows it will be assumed that the number of turns may be as few as six, which facilitates the formation of a hexagonal honeycomb grid for the extraction of hydrocarbon from an entire hydrocarbon deposit too large to be heated by a single arrangement according to the invention. However, some other number of conductors may be utilized in appropriate situations, and empirical evaluation of the effectiveness of the number of turns initially employed will undoubtedly be made in particular applications to determine whether a greater or fewer number of turns might be suitable. Obviously additional tunnels and drill holes can be provided to increase the number of turns as required.

While in the example of FIG. 1, the upper conductors 3 and the lower conductors 4 have been illustrated as being horizontal, it is to be understood that the orientation of these conductors may vary to accord with the angle of inclination of the upper and lower limits respectively of the underground hydrocarbon deposit required to be heated.

Figure 2:
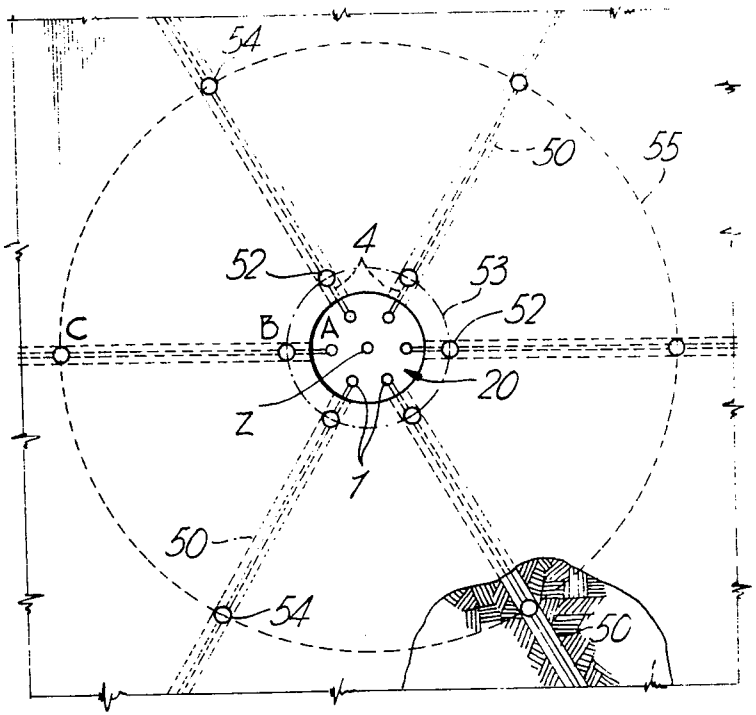
FIG. 2 is a schematic plan view of a portion of the surface of the earth, illustrating a preferred manner of locating vertical drill holes and horizontal tunnels in accordance with the present invention.

For the reasons previously discussed, there is a practical upper limit on the ratio of the outer radius of the quasi-toroidal envelope defined by vertical conductors 2 to the inner radius of the quasi-toroidal envelope defined by the location of the inner vertical conductor elements 1. For this reason it may be desirable to provide a further quasi-toroidal envelope surrounding that illustrated in FIG. 1. Such further quasi-toroidal envelope could utilize as its innermost vertical conductor elements the conductor elements 2 of FIG. 1. FIG. 2 illustrates in plan view the appropriate configuration both of vertical drill holes and horizontal tunnels in which the required coil segments can be located. Obviously only one of the two horizontal tunnels can be shown in plan view; one of any pair of horizontal tunnels of course will generally directly lie below the other horizontal tunnel in the pair.

In a central vertical circular cylindrical shaft 20 the inner vertical conductors 1 are located. Extending radially outwardly from the shaft 20 are horizontal tunnels 50 which we shall assume to be the lower horizontal tunnels required for the location of the lower horizontal conductors 4. The upper horizontal tunnels would then lie directly above tunnels 50. Intersecting with the horizontal tunnels 50 are vertical drill holes 52 in which vertical conductors 2 are located. The conductor arrangement thus defines an inner quasi-toroidal envelope whose outer periphery is generally defined by a notional cylindrical surface shown in plan view by a broken line circle 53 and whose inner periphery is the notional cylindrical surface defined by conductors 1.

The next quasi-toroidal envelope surrounding the inner quasi-toroidal envelope formed by conductors 1, 2, 3 and 4 will then be generated by extending the tunnels 50 radially outwardly from the drill holes 52 and sinking further vertical drill holes 54 which lie again on a notional cylindrical surface indicated in the plan view of FIG. 2 by broken line circle 55. These drill holes 54 thus necessarily lie at the apices of a further hexagon larger than that defined by the drill holes 52. The inner vertical conductors for the outer quasi-toroidal envelope are conveniently the already-placed vertical conductors 2 located in the drill holes 52. This achieves an economy both in drilling and in conductor utilization. If a further quasi-toroidal space is to be defined, the tunnels 50 can be extended further radially outwardly, a further set of vertical drill holes (not shown) provided, and appropriate extensions of the horizontal conductors and appropriate insertions of additional vertical conductors provided. The inner conductors for such hypothetical outer quasi-toroidal envelope would be the conductors provided in the drill holes 54.

If the centre of shaft 20 is indicated by Z, then the inner radius of the inner quasi-toroidal envelope will be ZA where A lies on the circle defined by the inner vertical conductors 1. The outer radius of the inner quasi-toroidal envelope will be BZ, where B lies on the circle defined by vertical conductors 2 located in drill holes 52. The outer next adjacent quasi-toroidal envelope has an inner radius BZ and an outer radius CZ, where C lies on the circle defined by drill holes 54.

Figure 3:
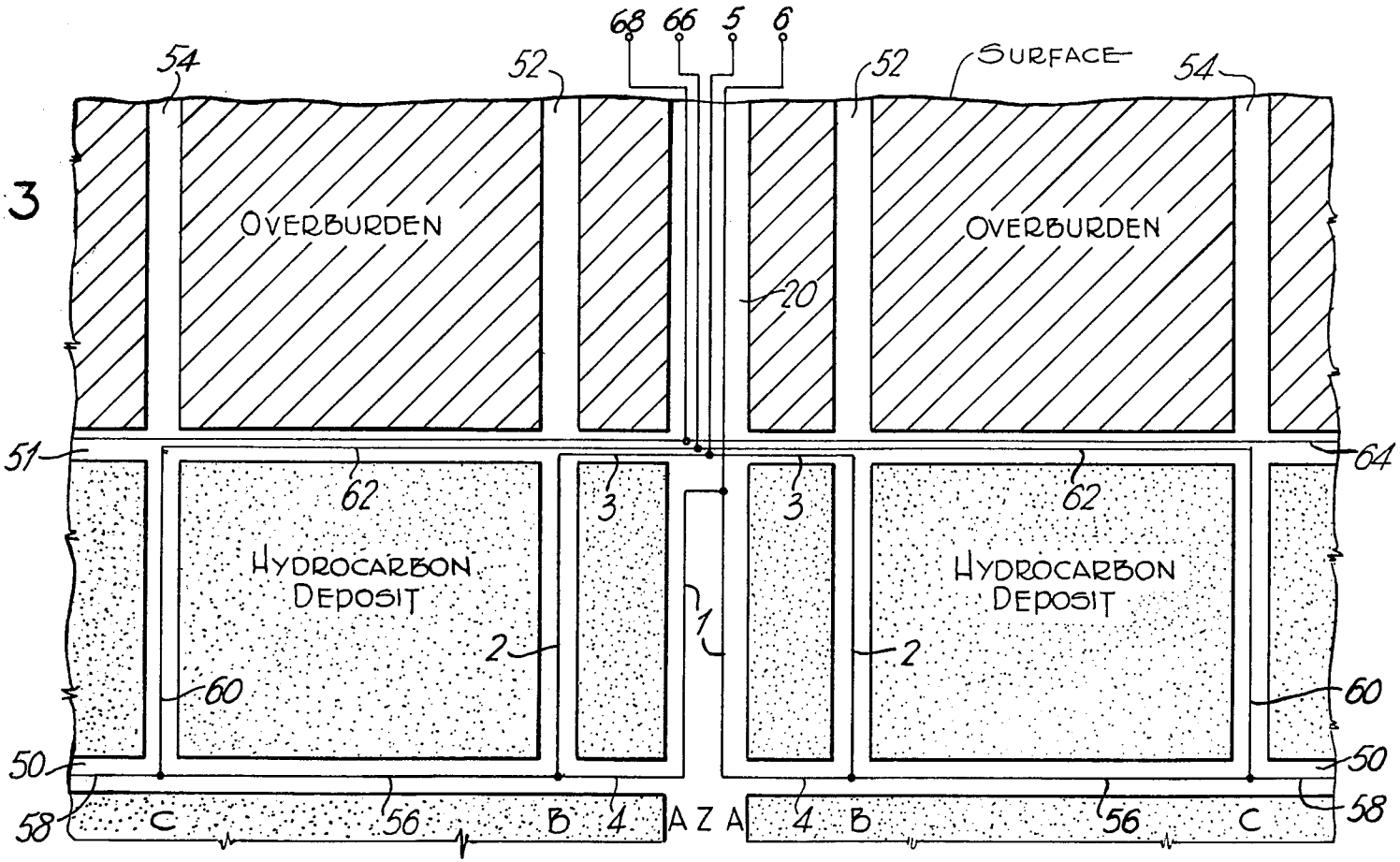
FIG. 3 is a schematic section view of the portion of the earth to which FIG. 2 relates, illustrating a preferred horizontal and vertical tunnel arrangement in accordance with the invention.

A further appreciation of the scheme of FIG. 2 can be had by referring to the schematic elevation view of FIG. 3, which is a section of the earth along one of the horizontal tunnels 50.

Extending radially outwardly from the central shaft 20 are the lower horizontal tunnels 50 located at or near the bottom of a hydrocarbon deposit which is separated from the surface of the earth by an overburden layer. A set of upper horizontal tunnels 51 extend radially outwardly from the central vertical shaft 20 at or near the upper limit of the hydrocarbon deposit. A first set of drill holes 52 define the outer limit of the innermost quasi-toroidal space to be surrounded by the quasi-toroidal conductive envelope. A further set of vertical drill holes 54 spaced radially outwardly from the drill holes 52 define the outer limit of the second quasi-toroidal space. Further vertical drill holes (not shown) could be provided yet further radially outwardly from the shaft 20 to define the outer limit of yet a further quasi-toroidal space.

Conductor elements 1, 2, 3 and 4 are shown connected to surface terminals 5 and 6 for connection to a source of alternating current in the manner previously described with reference to FIG. 1. It can be seen that the inner vertical conductors 1 lie generally along the periphery of the central shaft 20, that the vertical conductors 2 lie in drill holes 52 within the hydrocarbon deposit, that upper horizontal conductors 3 lie in the upper horizontal tunnels 51, and that the lower horizontal conductors 4 lie in lower horizontal tunnels 50.

To provide the rectangular turns required for the adjacent outer quasi-toroidal envelope, tunnels 50 and 51 are shown extending radially outwardly beyond vertical tunnels 52 to intersect an outer set of vertical drill holes 54. Horizontal conductor elements 4 can be continued as horizontal conductor elements 56 lying between drill holes 52 and 54. Vertical conductor elements 60 located in drill holes 54 are connected between horizontal conductor elements 56 and further horizontal conductor elements 62 located in upper horizontal tunnels 51. The interrupted rectangular turns therefore comprise conductor elements 2, 56, 60 and 62 for this quasi-toroidal envelope. The upper horizontal conductor elements 62 are connected to a terminal 66. Alternating current would then be applied across terminals 5 and 66 to energize the intermediate quasi-toroidal envelope..

The horizontal conductors 4, 56, can be further extended as conductor elements 58 to an outer set of vertical drill holes (not shown) in which an outer set of vertical conductors (not shown) may be located. These vertical connectors can then be connected to horizontal conductors 64 located in tunnel extensions 51 which in turn are connected to terminal 68 at the surface. Alternating current can then energize such outer quasi-toroidal envelope by being applied across terminals 66 and 68, it being perceived that the outer toroidal envelope utilizes at its innermost vertical conductors the vertical conductors 60 located in drill holes 54. This kind of progressive drill hole and circuit extension can be continued indefinitely to an outer economic limit.

It is of course necessary in the arrangement abovedescribed to make sure that the conductors 3, 62, 64, etc. located in horizontal tunnel 51 are insulated from one another. The selection of the tunnel 51 as containing a plurality of horizontal conductors whereas the tunnel 50 contains just one continuing horizontal conductor is of course arbitrary; the reverse arrangement might in some circumstances be preferred. Furthermore, it may be preferable in some circumstances to continue the vertical conductors upwardly through drill holes 52, 54, etc. and then to make surface connections from these drill holes rather than via the horizontal tunnels 51. Various alternative conductor configurations which will achieve essentially the same result will occur to those skilled in the art as being convenient and preferable in some situations.

The coil arrangement of FIGS. 1, 2 and 3 has been illustrated as involving a parallel connection between the turns. This is expected to be the most appropriate manner of interconnection of the turns, but a series coil connection could be substituted in a particular situation if considered appropriate by the designer. The manner in which a series connection can be arranged is within the ordinary skill of an electrical engineer.

The size of the tunnels 50 and 51 and the drill holes 52, 54 and of the central shaft 20 have been exaggerated for purposes of convenience of illustration. It is to be expected that these holes will be as small as possible consistent with the use that is to be made of them. The central shaft 20 for example will be utilized not only for the location of the conductors 1 and the connecting lines from terminals 5, 6, 66, 68, etc. but also will probably be required as a construction shaft into which men and machinery will enter for the purpose of excavating horizontal tunnels 50 and 51. The central shaft 20 may also be utilized to extract at least a portion of the hydrocarbon deposit through appropriate conduits. The drill holes 52 and 54 may conceivably be utilized not only for the location of the vertical conductor elements but may also conceivably be utilized for the injection of fluid into the hydrocarbon deposit or the extraction of at least a portion of the hydrocarbons from the deposit. In the event that gas under pressure is required to be injected into the deposit in order to facilitate extraction of hydrocarbons, it may be required to stop-up some of the vertical drill holes 52, 54, etc. to prevent the unwanted escape of gas from the hydrocarbon deposits.

Figure 4:
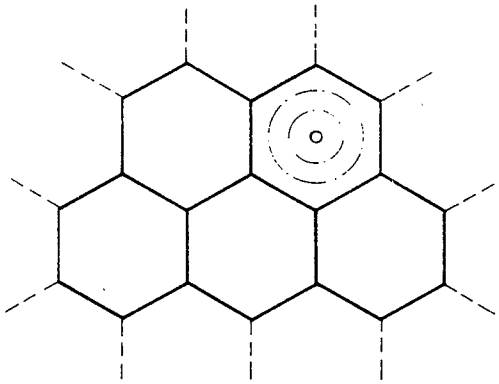
FIG. 4 schematically illustrates a grid arrangement on the earth's surface for the practice of a preferred hydrocarbon exploitation technique according to the invention.

FIG. 4 illustrates a hexagonal honeycomb grid, each hexagonal section thereof comprising a plurality of quasi-toroidal envelopes of the type illustrated in FIG. 2. The number of quasi-toroidal envelopes within any one hexagon will be determined by the economies of the situation, since generally speaking, it is expected that an outer radial limit for the outer periphery of a given quasi-toroidal envelope will be reached beyond which it is uneconomical to arrange further drill holes, tunnels, or conductor elements. However, the hexagonal arrangement of FIG. 4 permits as much of the underground hydrocarbon deposit as economically possible to be effectively exploited. It will be appreciated from the honeycomb of FIG. 4 that the two outermost drill holes for any one quasi-toroidal configuration can be utilized as the two outermost drill holes for a contiguous quasi-toroidal configuration, thus enabling optimum economic use to be made of the drill holes and the conductors located therein.

Figure 5:
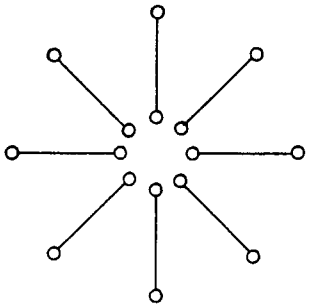
FIG. 5 schematically illustrates an alternative quasi-toroidal drill hole arrangement on the earth's surface in which the number of vertical drill holes and horizontal tunnels is greater than the number illustrated in the preceding figures.

Although six drill holes have been illustrated in FIG. 2 as being required for each succeeding quasi-toroidal stage, it may be desirable to utilize more than six drill holes in some circumstances. Additional drill holes, especially for the outermost quasi-toroidal envelopes, can be provided between those drill holes located at the apices of the hexagon. Or some other number of drill holes could be utilized in particular situations — for example, FIG. 5 illustrates in plan view a quasi-toroidal arrangement in which eight drill holes, turns, etc. are used.

Figure 6:
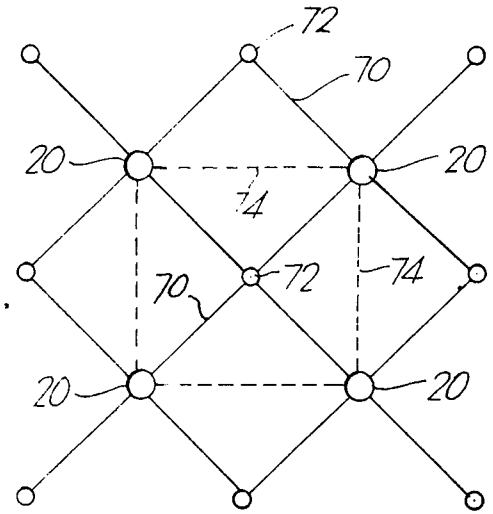
FIG. 6 schematically illustrates an alternative rectangular array of horizontal tunnels on the earth's surface interconnected by vertical drill holes, for use in the practice of an alternative hydrocarbon exploitation technique according to the present invention.

FIG. 6 illustrates a rectangular grid comparable to the hexagonal grid of FIG. 4 but in which four instead of six horizontal tunnels 70 extend radially outwardly from each of the central shafts 20 at angles of substantially 90° to one another. Drill holes 72 are located to intersect tunnels 70 at equal distances from the shaft 20. A grid can thus be established in which the drill holes 72 serve as many as four different shafts 20.

Since the electromagnetic field generated by only four turns will be relatively weak midway between the turn locations, additional turns can optionally be provided between adjacent shafts 20 as indicated by broken lines 74 which map the required horizontal tunnel locations. Note that these additional turns require no additional vertical drilling for their location but only two additional horizontal tunnels per turn. This grid design indicates the desirability of having several quasi-toroidal envelopes operating simultaneously.

Figure 7:
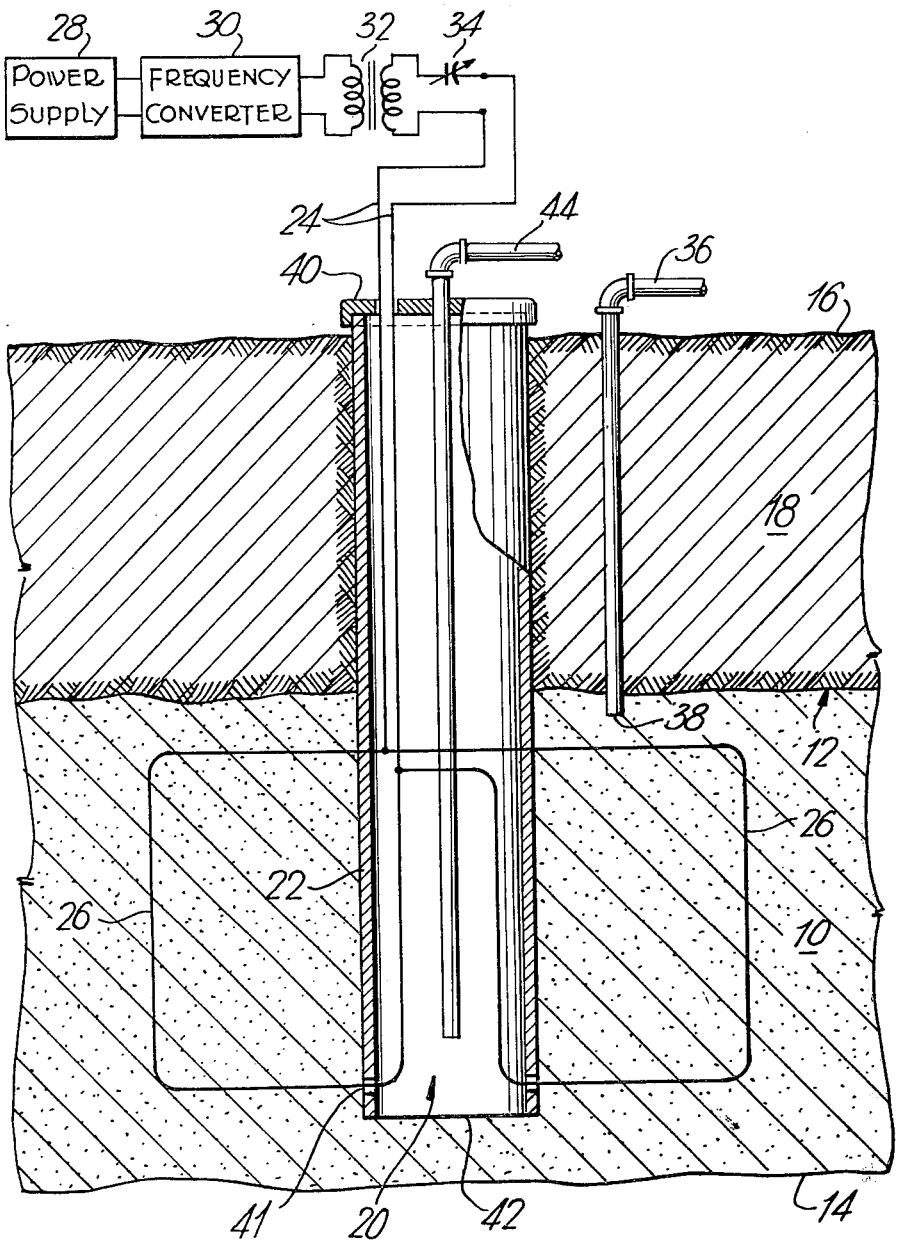
FIG. 7 illustrates a possible application of the teachings of the present invention to the extraction of hydrocarbons from oil shales.

In FIG. 7, a schematic illustration of structure suitable for hydrocarbon extraction from oil shales is illustrated. For simplicity, only the innermost quasi-toroidal conductor configuration is illustrated, but the description to follow can be applied *mutatis mutandis* to outer quasi-toroidal envelopes.

An oil shale 10 is shown having an upper boundary 12 and a lower boundary 14. The formation 10 is separated from the earth's surface 16 by an overburden layer 18.

A central shaft generally indicated as 20 is provided from the surface to the bottom or a point near the bottom of the oil shale formation 10. For structural strength and sealing of the shaft, the shaft walls are generally provided with an annular concrete reinforcing layer 22.

Electrical conductors 24 extend from the surface power supply and into the shaft 20 for connection to rectangular electric induction coil 26. This rectangular coils 26 extends outwardly from the shaft 20 to surround an annular quasi-toroidal volume of the oil shale formation 10. Electricity is supplied to the conductors 24 from a power supply 28 (e.g. a generator driven by a turbine which may be powered by a portion of the extracted hydrocarbons), whose output may optionally be passed through a frequency converter 30, a transformer 32, or both, depending upon the desired operating parameters for the system and upon the frequency and voltage at which the output from power supply 28 is available. A series-connected tuning capacitor 34 is also provided to resonate the circuit so as to facilitate maximum energy transfer to the volume of oil shale encompassed by the induction coil 26.

An injection pipe 36 may optionally be provided for injecting water into the hot formation for the purpose of generating steam when hydrocarbon extraction has been substantially completed, or for injecting gas under pressure into the oil shale to facilitate extraction of the hydrocarbons, or may be used to inject catalysts into the formation to facilitate cracking of residual coke after volatile fractions have been extracted. Note that the lower end 38 of the pipe is located just above and outside the induction coil 26, since if the pipe 36 were made of metal and the pipe penetrated the volume encompassed by induction coil 26, the result would be the undue absorption of energy by the pipe 36 within the heated volume with attendant risk of damage to the pipe, burning of adjacent kerogen, etc. One or more pipes 36 may be provided as required, depending upon empirical evaluation of the flow rate of hydrocarbons out of the oil shale deposit. One or more such pipes 36 could, instead of being located in separate drill holes, be provided within the shaft 20 and directed radially outwards through suitable openings in the concrete layer 22 into the interior of the oil shale formation.

The shaft 20 can serve at least initially as a suitable collection well. Projecting into the shaft 20 is an extraction pipe 44. To facilitate the flow of vaporized hydrocarbons out of the well, a horizontal concrete sealing layer (not shown) may be provided in the shaft 20 above the upper boundary of the oil shale layer. Alternatively, the shaft 20 may be capped, as illustrated in FIG. 7, by well cap 40. The extraction pipe 44 is preferably thermally insulated (at least above the well cap 40) to avoid heat loss from the flowing hydrocarbons. The flowing hydrocarbons may then be delivered at the surface by pipe 44 to a suitable energy extraction plant or processing plant (not shown).

Alternating current will be applied to the coil 26 at a frequency, voltage and amperage sufficient to heat the oil shale within the annular quasi-toroidal envelope formed by the induction coil 26. Since the electromagnetic field is strongest at the inner radius of the quasi-toroidal envelope, the entrapped kerogen will heat most quickly there to the boiling point of the lighter constituent fractions thereof. These escape into the shaft 20 via appropriately located gas escape holes 41. The vapor is then extracted via extraction pipe 44. As the heating progresses, heavier fractions of the kerogen near the inner radius of the quasi-toroidal envelope will be vaporized and extracted, and lighter fractions will be vaporized at increasing radii from the shaft 20. Eventually most of the kerogen within the quasi-toroidal envelope will be vaporized and, because in the ordinary case the overburden 18 will constitute an upper barrier to the escape of gas and vapor, the vapor will migrate towards the central shaft 20 to be extracted therefrom. If necessary, however, additional collecting pipes could extend from the surface into the oil shale formation above the quasi-toroidal envelope.

Since kerogen contains relatively light hydrocarbon fractions for the most part, it may be that the entire useful content of the oil shale can be drawn off by the procedure just described. However, if heavier oil constituents are also found in a particular oil shale formation, a coke residue may remain which, upon further heating and the injection of catalysts either via the extraction pipe 44, or via one or more injection pipes 36, may be cracked to release further vaporous hydrocarbon fractions. If the cracking process, however, is considered to be uneconomical, or if not all of the coke can be cracked successfully, the remaining coke residue can be burned in situ by injecting oxygen or air into the oil shale formation via suitably located injection pipes 36. (Additional injection pipes may be provided if desired into the quasi-toroidal volume after the electric current is turned off.) The combustion gases will then be drawn off via extraction pipe 44 or other suitably located extraction pipes and utilized to drive gas turbines or the like. Eventually, water can be injected via the injection pipe 36 into the hot oil shale and converted to steam by the residual heat. Steam can then be drawn off to the surface via extraction pipe 44 or other suitably located extraction pipes, and utilized at the surface in chemical process plants or in steam turbines. It is expected that after the firing of the remaining coke, if any, the oil shale will have reached a temperature of at least several hundred degrees Celsius, which should be sufficient to provide at least low pressure steam for utilization at the surface.

As the innermost quasi-toroidal volume becomes depleted of hydrocarbons, the next adjacent outer quasi-toroidal envelope can be energized and extraction continued from within that envelope. Depending upon the empirically determined flow characteristics within the oil shale formation, the central shaft 20 and extraction pipe 44 can continue to be used, or other suitably located extraction pipes can be provided to connect with the outer quasi-toroidal volume, as required.

It may also be found that in some instances the vaporization of some hydrocarbon fractions tends to generate pressure within the oil shale formation which forces other fractions in liquid form into the shaft 20, in which case the extraction pipe 44 could be utilized also as a conduit for extraction of the liquid fractions, by means of a suitable pump or the like (not shown).

Figure 8:
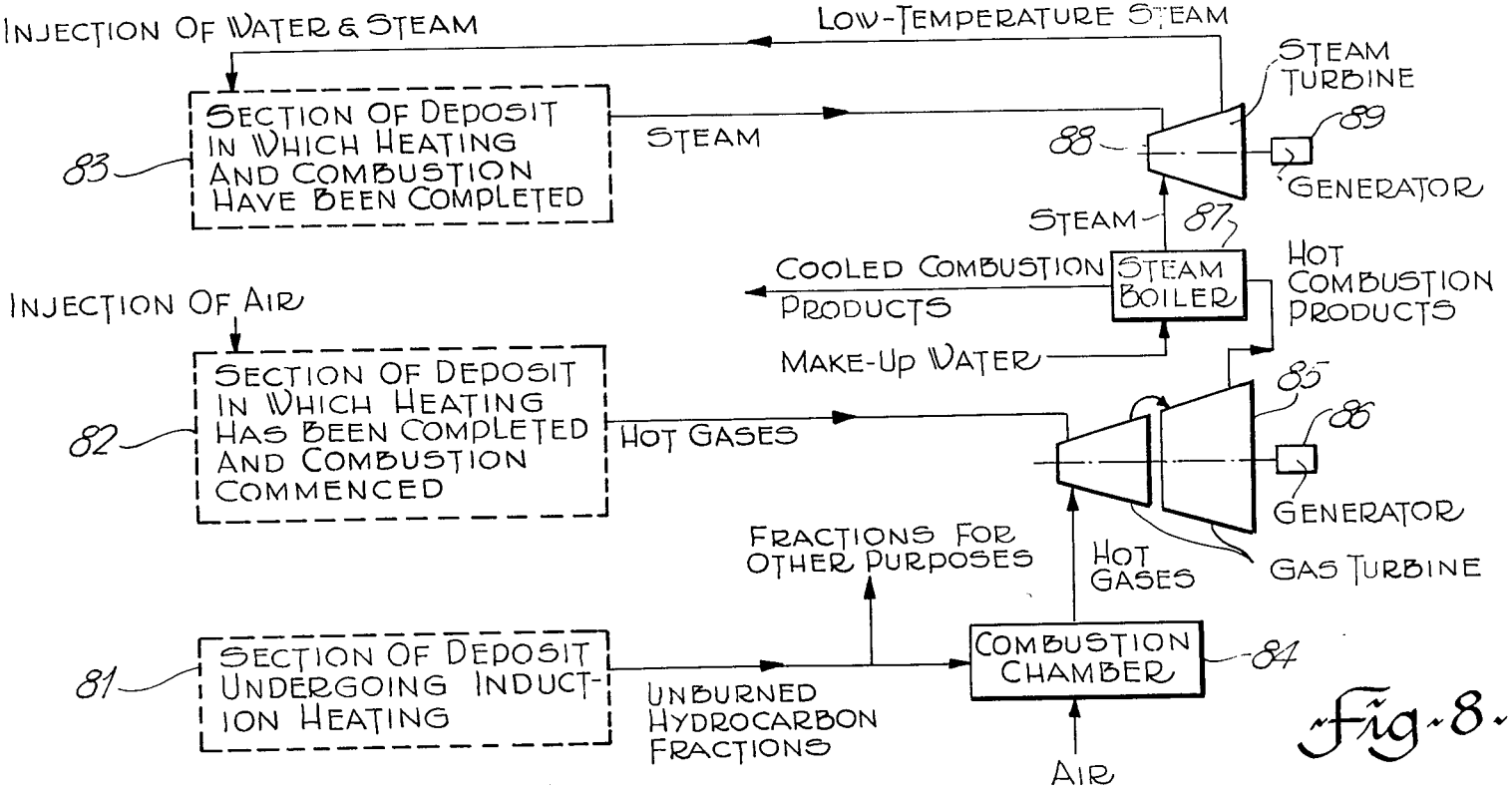
FIG. 8 is a flow chart illustrating energy utilization in accordance with another aspect of the present invention.

FIG. 8 shows schematically the integration of the electrical induction heating of an underground hydrocarbon deposit with one of the surface manufacturing processes discussed above, viz. the generation of electricity. Three sections 81, 82, 83 of the deposit are shown in various stages. The first of these sections (81) is undergoing heating by electrical induction. The hydrocarbon fractions are being distilled off, and such of these as desired are separated and further processed for other purposes. The remainder are fed to a combustion chamber 84 where they may be converted before combustion, or burned directly. The hot combustion products drive a two-stage gas turbine 85, which drives an electrical generator 86. The hot gases resulting from the combustion of coke or liquid hydrocarbons in the second section 82 of the underground deposit, in which induction heating has been completed also serve to drive the gas turbine 85. These gases, principally carbon dioxide, are exhausted still hot from the final stage of the gas turbine 85 and are then conducted to a steam boiler 87 where they generate steam. The cooled gases are then discharged to the atmosphere. The steam generated serves to drive a steam turbine 88, here shown single stage, and so drive generator 89 to generate electricity. Steam is also fed to the steam turbine 88 from a third section 83 of the deposit, in which steam exhausted from turbine 88 and water are injected. Air compressors, water pumps, and other accessory equipment may be driven directly by the turbines, or by electric motors supplied from the generators.

It will be apparent to those skilled in the art that in lieu of generation of electricity, the available thermal energy, hot gases, steam, and hydrocarbon constituents could be introduced into petrochemical plants or put to other appropriate uses.

What is claimed is:

1. A method of extracting hydrocarbons in situ from a selected portion of an underground hydrocarbon deposit such as oil shale, comprising forming a quasi-toroidal conductor arrangement in the deposit substantially to envelope the said selected portion, applying alternating current of selected voltage, amperage and frequency to the conductor arrangement to heat the selected portion by induction heating to a temperature sufficient to vaporize a portion of at least one of the hydrocarbon constituents thereof, and extracting a portion of at least one released hydrocarbon constituent of the deposit by means of a conduit extending from the deposit in the vicinity of the selected portion thereof to the earth's surface.

2. A method as defined in claim 1, comprising forming within the deposit a second quasi-toroidal conductor arrangement whose inner radius is substantially the outer radius of the first-mentioned quasi-toroidal conductor arrangement, and applying alternating current of selected voltage, amperage and frequency to the second conductor arrangement to heat hydrocarbons therein to a temperature sufficient to vaporize a further portion of said first-mentioned hydrocarbon constituent thereof, and extracting a further portion of said released hydrocarbon constituent from the deposit by means of a conduit extending from the deposit in the vicinity of at least one of said conductor arrangements to the earth's surface.

3. A method as defined in claim 2, wherein the ratio of the outer radius to the inner radius of each said quasi-toroidal conductor arrangement lies in the range 2:1 to 10:1.

4. A method as defined in claim 2, wherein the ratio of the outer radius to the inner radius of each said quasi-toroidal conductor arrangement is of the order of 5:1.

5. A method as defined in claim 1, comprising the additional steps of burning residual hydrocarbons in situ in the selected portion of the hydrocarbon deposit, and extracting the combustion gases via said conduit.

6. A method as defined in claim 5, additionally comprising driving a gas turbine with the combustion gases.

7. A method as defined in claim 1, comprising the additional steps of injecting water into the selected portion of the deposit, and extracting steam via said conduit.

8. A method as defined in claim 7, additionally comprising driving a steam turbine with said steam.

9. A method as defined in claim 1, wherein the conduit is located in the vicinity of the axis of the quasi-toroidal conductor arrangement.

10. A method as defined in claim 1 wherein the individual turns of the quasi-toroidal conductor arrangement are of interrupted rectangular configuration.

11. A method as defined in claim 10 wherein the quasi-toroidal conductor arrangement comprises six turns whose outermost conductive portions lie substantially on the apices of a regular hexagon.

* * * * *